United States Patent [19]

Ramlow et al.

[11] 4,322,953

[45] Apr. 6, 1982

[54] HEAT COLLECTION SYSTEM

[75] Inventors: Bryan L. Ramlow, Poynette; Richard R. Steele, Waterloo, both of Wis.

[73] Assignee: Atmospheric Energy Systems, McFarland, Wis.

[21] Appl. No.: 150,200

[22] Filed: May 15, 1980

[51] Int. Cl.[3] ..... F25B 41/04; G05D 23/00

[52] U.S. Cl. ..... 62/217; 62/238.6; 237/2 B

[58] Field of Search ..... 62/79, 324.4, 238.6; 237/2 B

[56] References Cited

U.S. PATENT DOCUMENTS

| | | | |
|---|---|---|---|
| 2,780,415 | 2/1957 | Gay | 237/2 B |
| 2,806,674 | 9/1957 | Biehn | 62/524 X |
| 2,986,015 | 5/1961 | Mitchell | 62/217 X |
| 2,986,344 | 10/1976 | Newman | 62/238.6 |
| 3,434,299 | 3/1969 | Nussbaum | 62/199 |
| 3,986,345 | 10/1976 | Pilz et al. | 62/238.6 |
| 4,006,857 | 2/1977 | Adrian | 62/238.6 |
| 4,120,173 | 10/1978 | Kimpel | 62/181 |
| 4,179,248 | 12/1979 | Shaw | 62/510 X |
| 4,202,493 | 5/1980 | Franchina | 62/238.6 |
| 4,263,785 | 4/1981 | Barniak | 62/79 |

*Primary Examiner*—William E. Wayner

*Attorney, Agent, or Firm*—Isaksen, Lathrop, Esch, Hart & Clark

[57] ABSTRACT

A heat collection system is disclosed which is capable of collecting heat from an animal husbandry enclosure (10), such as a dairy barn, and transferring the heat into a home (12). Animal husbandry enclosures, such as dairy barns, tend to have excess heat, even in winter, the excess heat normally being wasted. The heat is collected by a pair of evaporators (14, 16) located in the dairy barn (10), with the evaporators being oversized to limit the amount of cooling taking place in the barn. Fluid from the evaporators is compressed by compressors (24, 26) after which it passes through a condenser (30) from which heat may be extracted into the home (12). Pressure regulating valves (20, 34) are provided to insure that the compressors (24, 26) are not overloaded and to insure that a maximum heating effect is achieved. A thermostatically controlled fan (40) is provided to drive air across the condenser (30) so that heat is introduced into the home.

4 Claims, 1 Drawing Figure

HEAT COLLECTION SYSTEM

TECHNICAL FIELD

The present invention relates to heating systems in general, and, in particular, the heating systems designed to collect and transfer heat from one area to another without the transfer therebetween of any air or humidity.

DESCRIPTION OF THE PRIOR ART

It is generally recognized in the field of animal husbandry enclosures that such enclosures, wherein large numbers of relatively large animals are housed at all times tend to generate an overheating condition unless they are continually vented. Thus, dairy barns are required to have suitable powered ventilating equipment to exhaust air from the interior thereof in order to maintain the interior at a suitable temperature, even in the coldest days of winter. This is done, because, among other reasons, it has been discovered that dairy cattle provide maximum milk output when they live in an ambient temperature of about 40° F.

In prior art technology it was common to employ powered fans, ventilators, and other turbines to draw air out of a dairy barn and to exhaust the excess heat to the atmosphere, even during the winter. This excess heat, which is, in essence, latent solar heat stored by the vegetation upon which the animals feed, is thus normally wasted. In fact, there is even a net energy loss since energy is normally expended to drive this excess heat out of the dairy barn even during the winter.

It has been generally known in the prior art that heat can be transferred from one area to another using a contained fluid as the transfer medium. Thus the prior art is well aware of heat pumps capable of extracting heat from the outside air and introducing the heat into the interior of a heated structure. However, such heat pumps are generally better adapted for refrigeration, i.e., air conditioning, than for heating and are generally more specifically adapted for that purpose. Examples of heat pumps using the outside air and other media as heat sources are shown in the following U.S. Pat. No. 2,503,456; No. 3,885,938; No. 3,965,696; No. 3,386,344; No. 4,019,338; No. 4,033,738; No. 4,042,021; and No. 4,157,649. None of these cited prior art patents shows a system capable of collecting and transferring heat from an animal husbandry enclosure and none is particularly adapted simply for the transfer of heat in a heating mode since all intend that refrigeration can also be achieved.

SUMMARY OF THE INVENTION

The present invention is summarized in that a heat collection system includes a compressor; a condensor connected to receive compressed fluid from the compressor, the condenser being located in a space to be heated by heat transferred from the compressed fluid; a fluid return line carring fluid away from the condenser; a fluid expansion valve located in the fluid return line; and at least a pair of evaporators connected at one end to receive the expanded fluid from the expansion valve and at the other end to supply fluid to the compressor, the evaporators being oversized relative to the compressor and being located in a animal husbandry enclosure so that fluid therein is heated by the heat generated by the animals in the enclosure.

It is an object of the present invention to provide a system that is capable of collecting and transferring heat from a dairy barn into a home without the transfer therewith of the air and humidity of the dairy barn.

It is another object of the present invention to provide such a heat collection system which makes use of latent solar heat created by agricultural growth, which heat would otherwise be wasted.

It is a further object of the present invention to provide a heat collection system particularly adapted to transfer heat into an enclosure to be heated while making the minimum possible effect on the area from which the heat is being withdrawn.

Other objects, advantages, and features of the present invention will become apparent from the following specification when taken in conjunction with the accompanying drawings.

DETAILED DESCRIPTION OF THE PREFERRED EMBODIMENT

Figure 1:
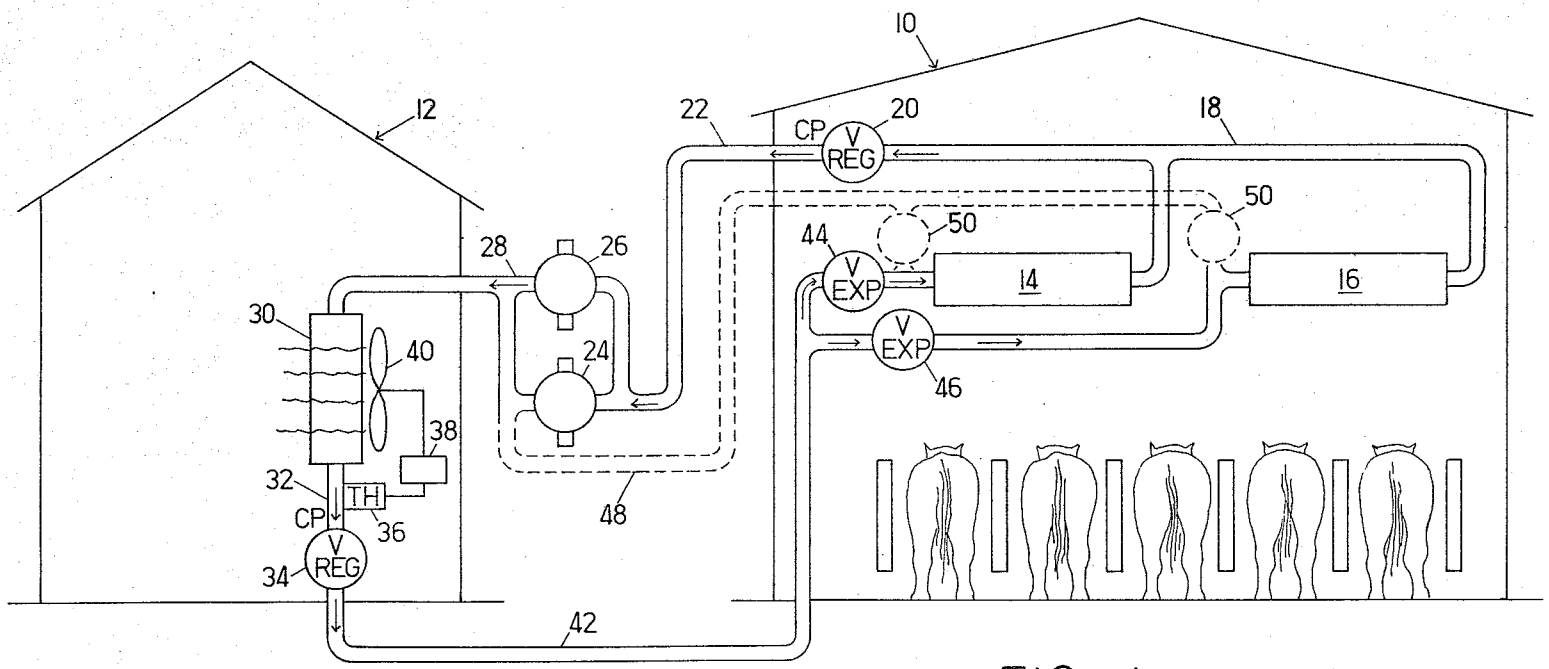
FIG. 1 is an schematic view of a heat transfer system constructed in accordance with the present invention.

Shown in FIG. 1 is a schematic illustration of a heat collection system designed to gather latent agriculturally-created solar heat constructed in accordance with the present invention. Generally indicated at 10 is an animal husbandry enclosure, such as a dairy barn, which normally has an excess amount of heat generated therein by the enclosed animals. Generally indicated at 12 is a home which is heated during the wintertime to make it suitable for human habitation. The heating system of the present invention is designed to transfer the excess heat normally generated in and then vented from the dairy barn 10, even in winter, into the home 12 without the direct transfer of any air or accompanying humidity from the dairy barn 10 into the home 12.

Located inside of the dairy barn 10 are at least two very large evaporators 14 and 16. In most installations a larger number of evaporators are used, i.e., in most installations four are used, but it is envisioned that as few as two could be appropriate for a given installation. Each of the evaporators 14 and 16 is designed so as to be elongated and to be oversized in BTU capacity with respect to the compressors, as will be discussed below. The evaporators 14 and 16 are typically placed relatively high in the barn so as not to be located too close to any of the animals in order to avoid chilling them. Suitable fluid piping 18 is connected to each of the evaporators 14 and 16 to transfer the fluid exiting from the evaporators 14 and 16 to a pressure regulating valve 20. The pressure regulating valve 20 acts to maintain no more than a maximum constant pressure in a connecting pipe 22 to which it connects. The constant pressure created by the pressure regulating valve 20 is selected so as to be matched to the capacity of the compressors, as will be discussed below and to be less than the pressure capacity of the evaporators 14 and 16. The connecting pipe 22 connects to a pair of compressors 24 and 26 which are connected in parallel. Both of the compressors 24 and 26 are connected to a common compressed fluid line 28. Each of the compressors 24 and 26 is designed to operate independently of the other so they can operate alternatively or together. The compressor 24, which is the main compressor utilized by the system, is selected so as to have a fluid compression capacity significantly less than would normally correspond to the heating capacity of the evaporators 14 and 16. The compressor 26 is selected of a power sufficient to add a boosting capacity to the power of the compressor 24 in high demand conditions.

The compressed fluid line 28 is connected into the interior of the home 12 to the condenser 30. The condenser 30 is located within the home 12 which is to be heated in such a manner so as to be able to supply heat to the home. For example, the condenser 30 could be installed as a part of a central forced-air heat system or, alternatively, could be installed as a radiating heat source in a room to be heated. A fluid return line 32 receives fluid from the output of the condenser 30 and connects in turn to a pressure regulating valve 34 which acts to maintain at least a constant minimum pressure in front of the pressure regulating valve 34, i.e., in the condenser 30. A thermostat 36 is mechanically attached to the fluid return line 32 and is in turn electrically connected to a motor control circuit 38 which controls the operation of a fan 40. The fan 40 is positioned behind the condenser 30 so as to blow air across the condenser 30 when the fan 40 is operated.

A continuation of the fluid return line 42 connects to the pressure regulating valve 34 and returns to the dairy barn 10 where it is connected to a pair of fluid expansion valves 44 and 46. The expansion valves 44 and 46 allow liquid inside of the fluid return line 42 to expand after passing through the expansion valves 44 and 46 so as to evaporate into a gas inside of the evaporators 14 and 16.

An evaporator defrost system which may be utilized within a system constructed in accordance with the present invention is shown in dashed form in FIG. 1. A compressed fluid line 48 is connected to the output of the compressors 24 and 26 and to the inputs of the evaporators 14 and 16. Connected to the compressed fluid line 48 are a pair of evaporator control valves 50, one for each evaporatar. The evaporator defrost system is designed to provide a capability to de-ice either one of the evaporators 14 and 16 while allowing the other to continue to collect heat to send to the home.

In its operation, the latent collection system of FIG. 1 functions to collect heat from the dairy barn 10 and transfer the gathered heat into the home 12. While the system does, in some respects, operate in a fashion similar to a refrigeration or heat pump system, it includes features specially selected and designed so as to be particularly adapted to the removal of heat from an animal husbandry enclosure, such as a dairy barn 10, in which it is critical that the temperature of the enclosure not be reduced by more than a small number of degrees.

Beginning in the cycle of the system just before the evaporators, compressed refrigeration fluid passes through the expansion valves 44 and 46 after which it expands so that it may be evaporated in the evaporators 14 and 16. The expansion and evaporation of the fluid in the evaporators 14 and 16 causes the fluid to drop in temperature, thereby absorbing heat from the interior of the dairy barn 10. The evaporators 14 and 16 are oversized with respect to the compressor 24 so that the total temperature differential across the evaporators 14 and 16 is relatively small. This small temperature differential is important so that the perceived temperature of the evaporators 14 and 16 is not significantly less than the overall interior temperature inside of the dairy barn 10. This is done to avoid cold spots in the barn which might adversely affect the animals and to avoid excessive cooling of the barn 10. The fluid piping 18 connects the output of the evaporators 14 and 16 to the pressure regulating valve 20 which also acts to make sure that the evaporators 14 and 16 do not become too cold.

The pressure regulating valve 20 acts to serve this function by limiting the pressure in the connecting pipe 22 connected to the compressor 24 to no more than a pre-selected maximum pressure to thus maintain a relatively high pressure in front of the pressure regulating valve 20, i.e., in the connecting pipe 18. This high pressure in the connecting pipe 18 tends to impede fluid flow through the evaporators 14 and 16 to provide an impediment to the cooling effect of the evaporators 14 and 16. This is done, as mentioned above, to keep the evaporators 14 and 16 at a relatively high temperature so that they do not excessively cool down any portion of the dairy barn 10. This feature is necessary in order to insure that the animals within the dairy barn 10 are not adversely affected by the presence of the evaporators 14 and 16 and to insure that only excess heat not needed to maintain body temperature of the animals is removed.

The fluid passing through the pressure regulating valve 20, which is at this time in vapor form, is compressed by the compressor 24. The compressor 24 is designed to operate during normal circumstances while the compressor 26 is connected in parallel to the compress 24 so as to operate only in maximum load operating circumstances. The compressor 24 acts to compress the fluid which is then transferred through the compressed fluid line 28 into the condenser 30. In the condenser 30 the compressed fluid, previously in gaseous form inside of the compressed fluid line 28, is converted into liquid by virtue of the heat transferred into the interior air inside of the home 12 from the fluid. The fan 40 functions to force air across the condenser 30 so that heat may be removed from the condenser 30 and transferred into other parts of the home 12. The pressure regulating valve 34 located on the fluid return line 32 after the condenser 30 operates to effectively maintain a minimum pressure in front of the pressure regulating valve 34. This minimum pressure is maintained so as to insure that the condenser 30 is maintained at a relatively high temperature at all times. In order for the inhabitants of the interior of the home 12 to be comfortably heated by heat from the condenser 30, it is necessary that the air passing over the condenser 30 be perceived to be warm. For moving air to be perceived to be warm to a person, it must be significantly hotter than the interior room air. Therefore it is necessary that the air passing over the condenser 30 be 15° to 20° F. warmer than the interior air in the inside of the house 12. By maintaining a high pressure in front of itself, the pressure regulating valve 34 impedes liquid flow through the condenser causing heat to build up in the condenser 30 making it hotter than would otherwise would be the case. This heat build-up in the condenser 30 cause the air driven across it by the fan 40 to be warmer than would otherwise be the case.

The thermostat 36, the associated motor control circuitry 38, and the fan 40 function to adjust the amount of air moving over the condenser 30 in response to the temperature of the fluid exiting from the condenser 30. The thermostat 36 is responsive to the temperature of the fluid in the fluid return line 32 which is proportional, in turn, to the temperature of the fluid within the condenser 30. This temperature as sensed by the thermostat 36 controls the operation of the motor control circuit 38 so as to operate the fan 40 at differing speed depending upon the temperature of the fluid within the condenser 30. If the fluid within the condenser 30 is relatively hot, the motor control circuit 38 operates the fan 40 at a relatively high degree of speed so as to move a large amount of air across the condenser 30 to introduce more heat into the interior of the home 12. If, however, the thermostat 36 senses a relatively low temperature in the fluid inside of the condenser 30, the motor control circuit 38 slows down the speed of the fan 40 so that the air passing through the condenser 30 is still perceived to be relatively warm to the inhabitants of the home 12.

Fluid from the pressure regulating valve 34 is conducted through the fluid return line 42 to the expansion valves 44 and 46 located inside of the dairy barn 10. The expansion valves 44 and 46 allow the fluid within the fluid return line 42 to expand under reduced pressure before being introduced into the evaporators 14 and 16 to complete the cycle of the heat collection system in FIG. 1.

Also shown in dashed lines in FIG. 1 is an evaporator defrost system which can be utilized to defrost either one of the evaporators 14 or 16. Such a system is desirable inasmuch as the atmosphere inside of a dairy barn 10 tends to have a high humidity. Since the temperature inside of the dairy barn 10 also tends to be relatively low, particularly in winter, the surface of the evaporators 14 and 16 can often drop below freezing thereby causing the high humidity inside of the dairy barn 10 to tend to deposit as frost on the evaporators 14 and 16. The evaporator defrost system functions to remove the frost from the evaporators. This system is controlled by the pair of evaporator control valves 50, one for each of the evaporators 14 and 16. When a condition is sensed requiring the defrosting of one of the evaporators, and the appropriate one of the evaporator control valves 50 opens thereby allowing hot compressed fluid exiting from the compressor 24 to be transferred directly to the input of the appropriate one of the evaporators 14 or 16. This hot fluid causes the appropriate evaporator to heat up to melt the frost deposited on the outside thereof. The heated fluid then passes back to the compressor 24 after which it may pass on to the condenser 30 so that the heat may be extracted from it.

The heat collection system as shown in FIG. 1 is particularly adapted for the transfer of heat, as opposed to conventional heat pump systems which are often most best adapted for refrigeration, rather than heating. For example, in a refrigeration system it is usually most important that a low temperature be maintained in the evaporators of the system. By contrast, in the system of the present invention the pressure regulating valve 20 insures that the fluid flow through the evaporators 14 and 16 is impeded so that the temperature of the evaporators 14 and 16 remain relatively high so as not to cool the dairy barn 10. This feature is particularly advantageous for evaporators located inside of an animal husbandry enclosure, such as the dairy barn 10, but is particularly inappropriate for a system, such as a heat pump, which is intended to act as a air conditioning or refrigeration system as well as a heating system. Similarly, the pressure regulating valve 34, which acts to slow the fluid flow through the condensor 30, insures that the condenser 30 is maintained at a relatively high temperature. In a conventional heat pump system, or other refrigeration system, it is only desired that the fluid passing through the condenser be reduced by some preselected temperature, while the actual temperature level of the condenser is less important. By contrast, in the system of the present invention the provision for the pressure regulating valve 34 is specifically designed to insure that the condenser 30 is relatively hot so that the heat transferred therefrom is relatively concentrated. Similarly, the provision for the thermostatic circuit 36 and the fan 40 helps to insure that the heat which is emitted by the condenser 30 is perceived to be warm by the inhabitants of the home 12.

Another difference between the system in accordance with the present invention and a convention refrigeration is the cooperation between the pressure regulating valve 20 and the compressor 24. The pressure regulating valve 20 is selected so that the pressure in the connecting pipe 22 is just sufficient so as to run the compressor 24 at precisely 100% of its rated load at all times. In a cooling system, this feature would cause the cooling part of the cycle to work less efficiently then might otherwise be the case, but this feature is particularly adapted to a heating system inasmuch as it insures that the compressor is not overloaded but yet makes optimum use of the energy needed to run the compressor 24. It is for this same reason that the evaporators 14 and 16 can be sized to have a greater capacity than the compressor 24, since the pressure regulating valve 20 insures that an excess load is not transferred to the compressor 24. For example, if a 3 Hp. compressor is rated at 3,000 BTU's, it would be possible to have evaporators 14 and 16 rated at 50,000 BTU's. The excess capacity of the evaporators 14 and 16 would not effect the operation of the compressor 24 because of the pressure regulating valve 20 while at the same time maintaining a full load condition to the compressor 24 and a low temperature differential across the evaporators 14 and 16.

While the operation of the heat collection system of the present invention is particularly adapted to generating space heat for the inside of a home, it is also envisioned that the heat may be utilized for other purposes. For example, during the summer when the excess heat is not required inside of the home 12, the hot fluid pumped from the compressor 24 could be piped into another location to heat water or dry clothes. Similarly, the compressed hot fluid could be used as a heat source for a variety of other farm chores in which heating of some product, such as crops, is required. It is essential, of course, that the condenser 30 be located inside of the space where the heat is to be utilized whether that be the home 12 or other enclosure. Heat produced in this fashion can be produced at current prices significantly cheaper than competing non-renewable fuel sources such as liquid petroleum gas or natural gas.

It is to be understood that the present invention is not limited to the particularly construction and arrangement of parts disclosed and illustrated herein, but embraces all such modified forms thereof as some within the scope of the following claims.

We claim:

1. A heat collection system comprising:

a first compressor;

a second compressor connected in parallel to the first compressor;

a condenser connected to receive compressed fluid from the compressors, the condenser being located in a space to be heated by heat transferred from the compressed fluid;

a fluid return line carrying fluid away from the condenser;

a fluid expansion valve located in the fluid return line;

at least a pair of evaporators connected in parallel at one end to receive the expanded fluid from the expansion valve and at the other end to supply fluid to the compressors, the evaporators being located in an animal husbandry enclosure, the evaporators both being oversized relative to the compressors so as to remain at a relatively high temperature to avoid extensive cooling of the animal husbandry enclosure;

a first pressure regulating valve connected between the evaporator and the compressor so as to maintain a constant pressure in the fluid transferred to the compressor so that the compressor is not overloaded and so that fluid flow through the evaporator is slowed; and a second pressure regulating valve connected in the fluid return line adjacent to the condenser to maintain a constant pressure in the condenser so that the fluid temperature in the condenser is maintained at a high level;

the pressure regulating valves acting with the oversized nature of the evaporator to keep the evaporator at a relatively high temperature, while still heating the refrigerant fluid with excess heat from the animals in the enclosure, so that the enclosure is not overly cooled at localized spots, while at the same time maximizing the heat of the fluid at the condenser to provide maximum heat to the space to be heated.

2. A heat collection system as claimed in claim 1 wherein there is a fan arranged to drive air across the condenser so that heat is extracted therefrom.

3. A heat collection system as claimed in claim 2 wherein there is a thermostat attached to the fluid return line adjacent to the condenser and connected to control operation of the fan so that the speed of operation of the fan is proportional to the temperature of the fluid in the condenser.

4. A heat collection system as claimed in claim 1 wherein the animal husbandry enclosure is a dairy barn.

* * * * *